United States Patent [19]

Davis

[11] 4,307,765

[45] Dec. 29, 1981

[54] COVER FOR LUGGAGE CASE AND METHOD OF MAKING

[75] Inventor: Michael Davis, New Castle, Pa.

[73] Assignee: Airway Industries, Inc., Ellwood City, Pa.

[21] Appl. No.: 111,205

[22] Filed: Jan. 11, 1980

Related U.S. Application Data

[63] Continuation of Ser. No. 820,597, Aug. 1, 1977, abandoned.

[51] Int. Cl.[3] ..... A45C 3/02

[52] U.S. Cl. ..... 150/1.6; 190/26; 190/41 R; 190/53; 150/52 R; 428/57; 428/79; 428/102; 428/76; 428/81

[58] Field of Search ..... 428/81, 57, 60, 77, 428/78, 79, 102, 189, 190, 58, 68, 76, 192, 54, 35, 14, 473, 45, 47, 55; D87/1 R, 5 B, 5 F, 3 C, 5 G; 190/41 R, 53, 26; 150/1.6, 52 R; D3/76

[56] References Cited

U.S. PATENT DOCUMENTS

| | | | |
|---|---|---|---|
| D. 112,729 | 12/1938 | Worthington | D3/76 |
| D. 159,128 | 6/1950 | Alpert | D3/76 |
| 948,165 | 2/1910 | Erstling | 190/53 |
| 958,860 | 5/1910 | Dresner | 190/53 |
| 1,119,517 | 12/1914 | Kaufmann | 190/53 |
| 1,871,197 | 8/1932 | Plotkin | 150/52 R |
| 1,964,820 | 7/1934 | Kaufman | D3/76 |
| 2,661,823 | 12/1953 | Goetz | 190/53 |
| 3,309,451 | 3/1967 | Holtzman | 264/258 |
| 3,582,441 | 6/1971 | Gaffan | 428/77 |
| 4,042,433 | 8/1977 | Hardy et al. | 428/79 |

FOREIGN PATENT DOCUMENTS

| | | |
|---|---|---|
| 191613 | 7/1919 | Canada . |
| 266482 | 12/1926 | Canada . |
| 459035 | 8/1949 | Canada . |
| 574132 | 4/1959 | Canada . |

OTHER PUBLICATIONS

New Products, Luggage & Leather Goods, Jul. 1974, p. 22.

*Primary Examiner*—Stanley S. Silverman
*Attorney, Agent, or Firm*—Buell, Blenko, Ziesenheim & Beck

[57] ABSTRACT

A cover for a luggage case, embodying decorative side panels of simulated multi-laminar construction. Portions of the periphery of the principal sheet of covering material are cut away and decorative strips fastened in overlying outwardly projecting relation to the cut away portions to complete the outer contour of the principal sheet. The edge of a surrounding strip is attached, as by stitching, to the outer peripheral edge of the combined principal sheet and decorative strips. After securing the overlapping ends by stitching together, the surrounding strip is readily disposed at a right angle for attachment to the shell of the luggage case.

1 Claim, 7 Drawing Figures

COVER FOR LUGGAGE CASE AND METHOD OF MAKING

This is a continuation of application Ser. No. 820,597, filed Aug. 1, 1977, now abandoned.

This invention relates to a cover for a luggage case, such as an attache case, in which the side panels simulate multi-laminar construction, but which, in fact, comprises only a single layer of sheet material constituting the side panel.

In my copending application Ser. No. 758,671, filed Jan. 12, 1977, I have disclosed a new design of side panel for a luggage case characterized by a decorative design having the edge wise appearance of a multi-laminar construction. This design of side panel is characterized by some degree of thickness which makes it difficult for the person doing the stitching of the laminations.

It is the purpose of my present invention to provide a cover for a luggage case which gives the appearance of the side panel design in the aforesaid copending application Ser. No. 758,671, but which is characterized by greater ease of workability due to the reduce number of the laminations making up the cover.

I accordingly provide a cover for a luggage case characterized by a novel construction and method of making.

Figure 1:
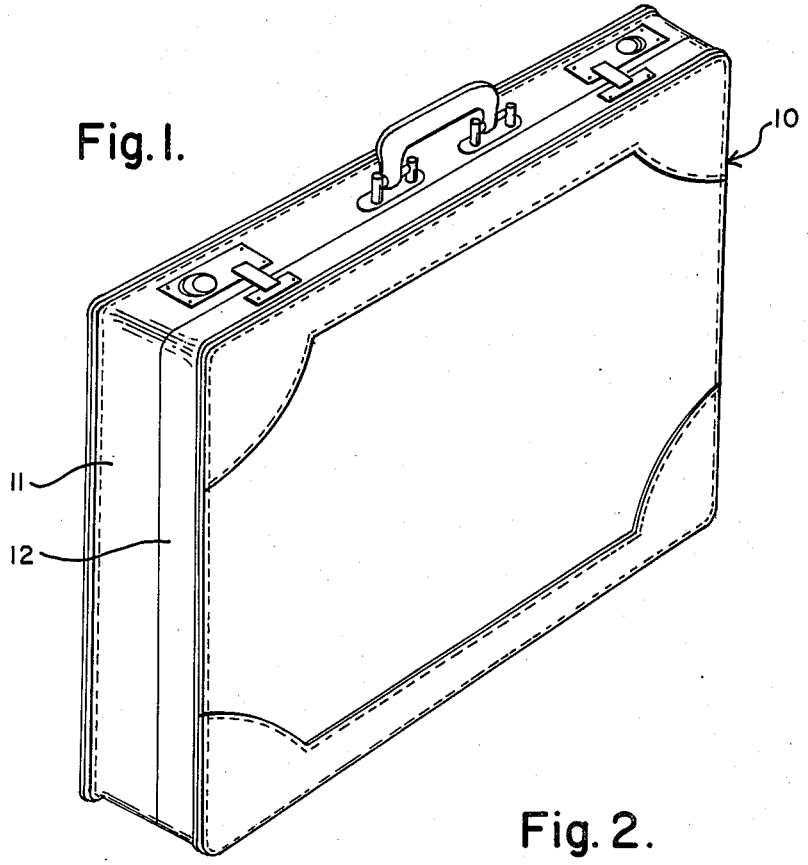

A preferred embodiment of my cover for a luggage case and its method of manufacture are more fully described hereinafter in connection with the accompanying drawings, wherein:

FIG. 1 is a perspective view showing a luggage case on which a cover made according to the method of my invention is shown in its installed position.

Figure 4:
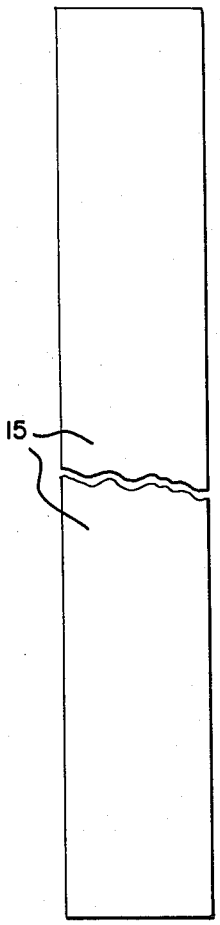
Figure 2:
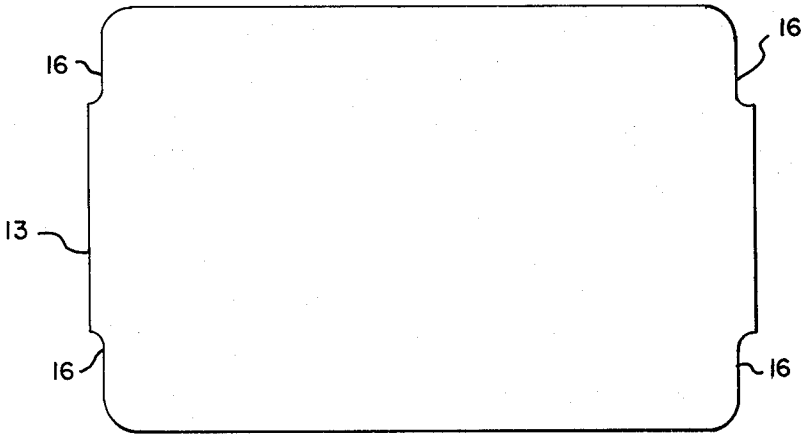
Figure 3:
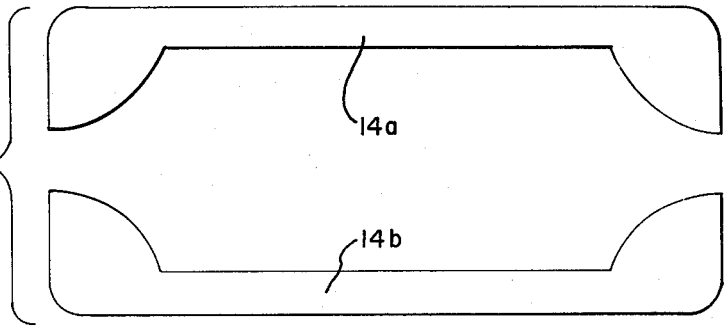
Figure 5:
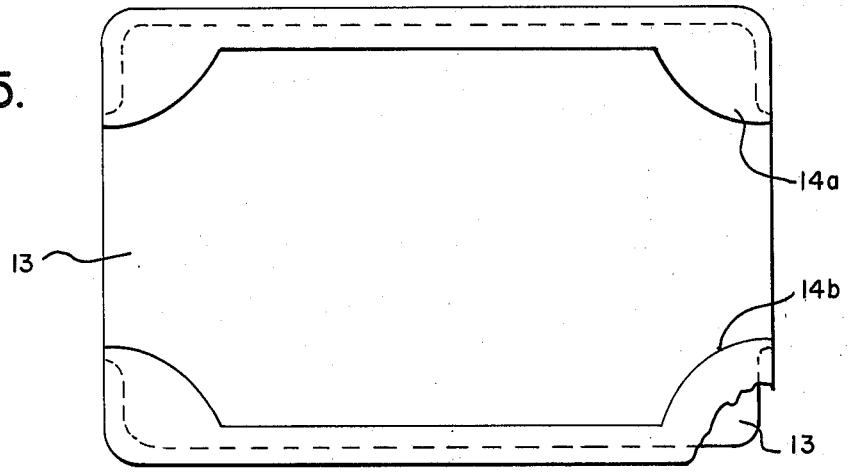
Figure 6:
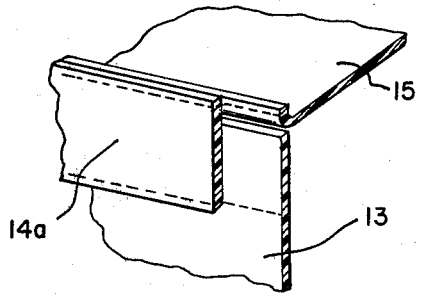
Figure 7:
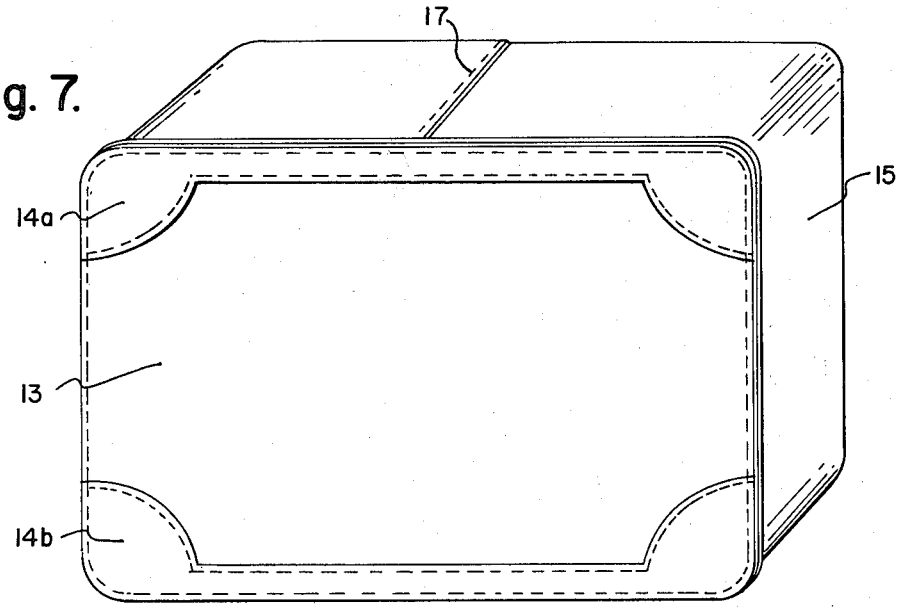

FIGS. 2, 3, and 4 are views, showing respectively, the principal covering sheet, the decorative strips and the mounting strips comprising the novel cover, FIG. 5 is a view, illustrating the first step in making the cover, FIG. 6 is a partial sectional perspective view, through a corner edge of the luggage case, showing the relation of the parts of the cover in the assembled state, and FIG. 7 is a perspective view, showing the appearance of the cover in its finally completed form.

As will be evident from FIG. 1, the luggage case 10, as a whole, comprises two shells of substantially rectangular shape, one being shallower than the other to provide a main body portion 11 and a closure member 12. Both the body portion and the closure member are covered by preformed covers correspondingly made and installed. For convenience, only the cover for the body portion 11 of the case and its method of manufacture will be described, but it will be understood that the cover for the closure member is similar in construction and method of making.

Referring to FIGS. 2, 3 and 4 of the drawings, the parts forming the cover for the body portion 11 are shown in the form or contour to which they are cut, prior to assembly and installation. The parts are made of suitable fabric material or of flexible plastic material, such as vinyl, of a thickness of approximately 1/16 of an inch (or 2mm). If desired, various combinations of material may be employed for different parts, such as fabric and vinyl. The vinyl sheet may have an outer surface of simulated leather finish and an interior surface consisting of a layer of smooth fabric material.

As will be seen in the drawings, the cover consists of four parts, a main cover sheet 13, (FIG. 2), two similar decorative strips 14*a* and 14*b* (FIG. 3) and a peripheral strip 15 (FIG. 4).

As will be noted from FIG. 2, the main cover sheet 13 has the four corners thereof cut away or recessed at 16. The initial step of assembly of the cover comprises placing narrow bands of glue along the top and bottom edges of the outer surface of the main cover sheet, and then in the manner shown in FIG. 5, placing the decorative strips 14*a* and 14*b* in overlying relation to the recessed corners and to the top and bottom glued areas of the main cover and pressing the strips 14*a* and 14*b* to the main cover sheet to cause them to stick together.

The next step of the assembly of the cover is the stitching of the strips to the main cover sheet along the contour of the quadrant sectors at opposite ends of the decorative strips 14*a* and 14*b* and along the straight edge connecting them. (see FIG. 6)

By reason of the recessed corners in the main cover sheet 13 and the fact that the decorative strips 14*a* and 14*b* project beyond the top and bottom edges of the main cover sheet there is only a single thickness of sheet material around the entire periphery of combined parts 13, 14*a* and 14*b* as seen in FIG. 5.

The next step in the assembly consists simply in aligning one edge of the strip 15 with the outer edge of the strip 14*a* (or 14*b*) and stitching the two together, then following on around the length of the strip 15 until it is entirely secured, by stitching to the peripheral area of the assembled parts 13, 14*a* and 14*b*. (FIG. 6)

The final step in assembling the cover consists simply in bending the strip 15 back into perpendicular relation to the main cover sheet, as shown in FIGS. 6 and 7, and stitching through the overlapping end portions thereof at 17.

The cover is readily installed in conventional manner by slipping over the body shell or closure shell, folding the excess width of the strip 15 back over the peripheral edge of the wall of the shell and sticking the cover by a suitable adhesive to the interior surface of the shell wall.

When the cover is made of vinyl sheet material, the exposed edges of the main cover sheet 13 do not require any covering. However, if the main cover sheet 13 is made of fabric material and the decorative strips 14*a* and 14*b* of vinyl material, the side edges of the fabric material are also cut off, similar to the top and bottom edges and vinyl strips are first glued and then sewn in projecting relation between the quadrant sections of the decorative strips so as to provide a single thickness of vinyl sheet entirely around the main cover sheet of fabric material.

It will be seen that I have provided a simple and relatively easy way of assembling a cover for a luggage case, which simulates a multi-laminar decorative appearance but which is conveniently worked since actually only a single thickness of covering material is employed.

In the foregoing specification I have described presently preferred embodiments of my invention; however, it will be understood that my invention can be otherwise embodied within the scope of the following claims.

I claim:

1. A cover for a three-dimensional shell of a rectangular luggage case, said cover being formed from a plurality of sheets of flexible relatively thin material and including a panel disposed to cover a side of the shell, a second panel disposed to extend peripherally around the shell, and an outwardly projecting edge of material interposed between the side panel and the peripheral panel, said cover comprising a flat main member of flexible relatively thin sheet material having a back which is placed facing the shell and a face which is placed facing away from the shell, said material having a substantially rectangular contour from which marginal areas are removed to provide an irregular contour, the flat main member thereby being smaller than the side of the shell and leaving at least some areas of the side of the shell uncovered, at least one secondary flat member of flexible relatively thin sheet material with a back which is placed facing the shell and a face which is placed facing away from the shell, said sheet material being attached to the main member with the back of the secondary flat member in juxtaposition to the face of the flat main member and positioned to overlie the outer edge of the main member at the edge of the removed marginal area and to extend beyond said edge of the main member at the removed areas thereby to fill in said removed areas whereby said main member and said secondary flat members together form the panel covering the side of the shell and provide a single thickness of material around substantially the entire edge of said panel, and a third member of flexible relatively thin sheet material extending around the periphery of the composite sheet formed by the main member and secondary members, and having a back which is placed facing the shell and a face which is placed facing away from the shell an edge of the third member being attached to the edge of the composite member in back to back relationship whereby when the cover is positioned on the shell the attached edges of the composite member and the third member project outwardly adjacent the intersection of the side panel of the shell and the periphery thereof.

* * * * *